United States Patent [19]

Benteler et al.

[11] 4,331,015

[45] May 25, 1982

[54] TUBE BENDING MACHINE WITH AXIALLY MOVABLE INNER CORE

[75] Inventors: Hubertus Benteler, Bielefeld; Wolfgang Streubel, Barntrup; Egon Olszewski, Paderborn-Elsen, all of Fed. Rep. of Germany

[73] Assignee: Benteler-Werke AG, Paderborn, Fed. Rep. of Germany

[21] Appl. No.: 126,832

[22] Filed: Mar. 3, 1980

[30] Foreign Application Priority Data

Mar. 15, 1979 [DE] Fed. Rep. of Germany ..... 2910183

[51] Int. Cl.[3] ..... B21D 9/05

[52] U.S. Cl. ..... 72/133; 72/134; 72/150

[58] Field of Search ..... 72/133, 134, 149, 150, 72/307, 422; 414/748, 751, 753

[56] References Cited

U.S. PATENT DOCUMENTS 2,714,324 8/1955 Dinsmore et al. ..... 414/748

3,287,952 11/1966 Van Harten ..... 72/150

FOREIGN PATENT DOCUMENTS 1923157 1/1971 Fed. Rep. of Germany ..... 72/150

*Primary Examiner*—Lowell A. Larson

*Attorney, Agent, or Firm*—Michael J. Striker

[57] ABSTRACT

A tube bending machine comprises a tube bending mechanism per se for bending a front portion of a tube inserted therein and fluid operated units for moving a mandrel in axial direction into the tube to be bent and for withdrawing the mandrel through a rear end of the tube after bending. A tube magazine is located to one side of the bending mechanism and a tube depositing station for receiving the bent tube is located at the other side thereof. A gripping and transfer apparatus is provided which includes two transversely spaced grippers on opposite ends of an arm movable in vertical direction, preferably by a fluid-operated cylinder-and-piston unit, and the whole gripping and transfer apparatus is movable on a horizontal guide rail with the grippers on the arms spaced from each other in such a manner that when the gripper and transfer apparatus is in the region of one end of the rail one of the grippers can grip a tube at a receiving station of the magazine and the other gripper a finished bent tube in the bending mechanism, while when the gripper and transfer mechanism is in the region of the other end of the guide rail the one gripper can place the one tube into the bending mechanism, while the other gripper places the finished bent tube onto the depositing station.

7 Claims, 5 Drawing Figures

TUBE BENDING MACHINE WITH AXIALLY MOVABLE INNER CORE

BACKGROUND OF THE INVENTION

The present invention relates to a tube bending machine with an inner mandrel for the tubes to be bent.

In tube bending machines of the aforementioned kind so far known in the art, the individual tubes to be bent are from the front end of the bending machine moved on to the inner mandrel and after the bending operation again ejected from the machine over the front end of the mandrel, whereafter, a new tube is moved onto the inner mandrel from the front end of the latter.

These known tube bending machines have, however, various disadvantages. One of the disadvantages is that relatively long idle times occur in these machines between two bending operations, which are due to the ejection of the bent tube over the front end of the mandrel and the subsequent moving of a new tube on to the mandrel from the front end of the latter. This necessity of moving the tubes to be bent into the tube bending machine from the front end of the latter makes a continuous operation of the machine impossible which is a further disadvantage of such known tube bending machines.

SUMMARY OF THE INVENTION

It is an object of the present invention to provide a tube bending machine with an inner mandrel for the tubes to be bent, which is constructed in such a manner that the idle time between two bending operations of two different tubes is considerably reduced as compared with tube bending machines of the aforementioned kind known in the art.

It is a further object of the present invention to provide a tube bending machine of the aforementioned kind which is constructed of few relatively simple parts so that the tube bending machine may be produced at reasonable cost and will stand up perfectly under extended use.

With these and other objects in view, which will become apparent as the description proceeds, the tube bending machine according to the present invention mainly comprises a tube bending mechanism, a tube magazine located laterally of the tube bending mechanism, gripping and transfer means for transferring tubes individually from the tube magazine into the tube bending mechanism with a first portion of tube located in said tube bending mechanism and a rear portion thereof projecting rearwardly from the latter, and for moving an inner mandrel in axial direction through said rear portion into said tube after the first tube portion has been placed into the tube bending mechanism.

The tube bending machine according to the present invention has the decisive advantage that a finished bent tube can be laterally removed from the tube bending mechanism after the inner mandrel has been retracted and at the same time a new tube to be bent may be placed into the tube bending mechanism. In this way the idle time between two bending operations may be considerably reduced in accordance with the present invention so that the output of the tube bending machine according to the present invention is considerably increased as compared with the output of known tube bending machines.

In this connection it is further advantageous that the mandrel is retracted after the gripper has gripped the bent tube and during opening of the clamping jaws of the tube bending mechanism.

The tube magazine preferably includes a tube receiving station extending parallel to and at a given distance laterally from the axis of the mandrel and separator means for moving one tube after the other from the remainder of the magazine to the receiving station.

The gripping and transfer means preferably comprise an arm extending transverse to the axis of the mandrel, a pair of grippers on opposite ends of said arm spaced the aforementioned given distance from each other, means connected with the arm for lifting and lowering the same, and means for moving said gripping and transfer means in the direction transverse to the axis of the mandrel.

The means for moving the gripping and transfer means in the aforementioned transverse direction preferably comprise a horizontally extending guide rail and rollers on the gripping and transfer means for guiding the latter along the guide rail.

The means for moving the inner mandrel in axial direction preferably comprise a hydraulically operated mandrel withdrawal cylinder-and-piston unit having a short stroke and a tubular pneumatically operated mandrel moving cylinder-and-piston unit with a long stroke.

The gripper at opposite ends of the aforementioned arm are preferably mounted thereon universally adjustable.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
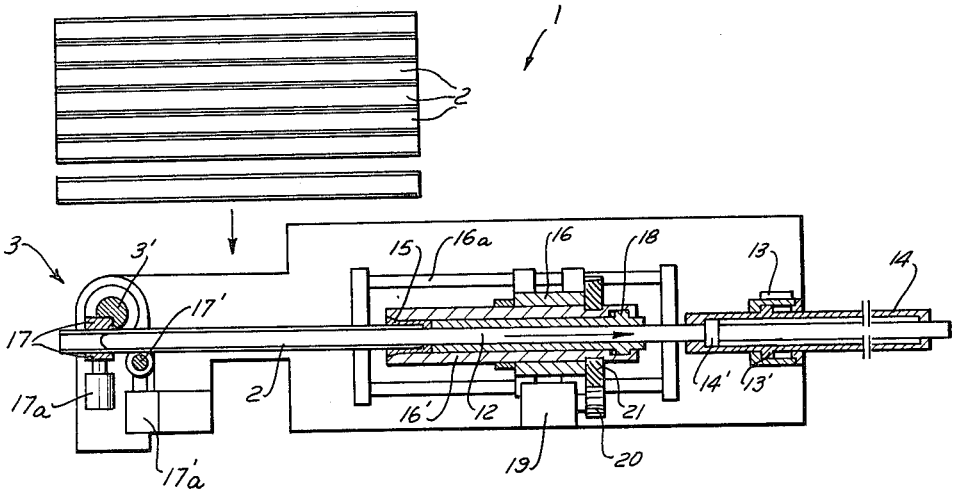
FIG. 1 is a schematic top view of a tube bending machine according to the present invention.
Figure 2:
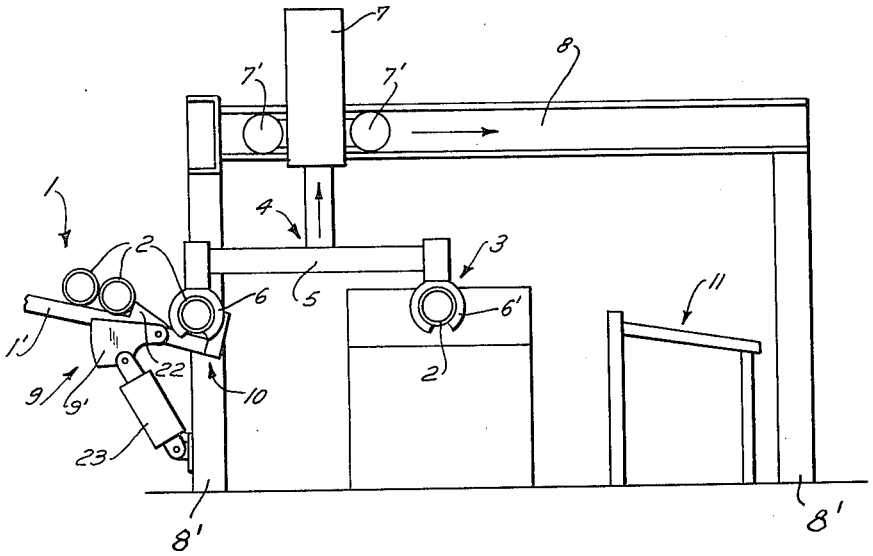
FIG. 2 is a schematic front view of the tube bending machine shown in FIG. 1 and especially illustrating the tube gripping and transfer mechanism, not shown in FIG. 1.

Referring now to the drawing, and more specifically to FIGS. 1 and 2 of the same, it will be seen that a tube magazine 1 is arranged laterally and to one side of the actual tube bending machine 3, in which a plurality of tubes 2 to be bent in the machine are located.

The tube magazine 1 has an inclined support plate 1', as shown in FIG. 2, from which an arresting member 22 projects in upward direction so that one of the tubes 2 in the magazine 1 will abut against this arresting member and the other tubes against each other. A tube separator 9 is provided to transfer the tube abutting against the arresting member 22 to a receiving station 10 located to the right side, as viewed in FIG. 2, of the arresting member. The separator 9 includes two plate shaped members 9' respectively adapted to engage opposite ends of the tube 2 abutting against the arresting member 22 which extend beyond the support plate 1'. The members 9', of which only the front member is shown, are tiltably mounted at one of the ends thereof on the base plate 1' and the members 9' may be moved in clockwise direction about their tilting axes by cylinder-and-piston units 23 so as to lift the tube abutting against the arresting member 22 to raise the tube above the arresting member so that the tube will roll down to the receiving station 10, whereafter the members 9' are returned to their starting position, as shown in FIG. 2 so that the next tube may roll in engagement with the arresting member.

The bending machine includes further a gripping and transfer device 4 by means of which a tube at the receiving station 10 may be transferred into the actual tube bending mechanism 3.

The gripping and transfer device 4 includes a horizontally extending arm 5 extending substantially normal to a tube located in the receiving station 10 and carrying at opposite ends a pair of grippers 6 and 6'. The arm 4 is movable in vertical direction by a fluid operated cylinder-and-piston unit 7 which is carried by a carriage mounted on wheels 7', which in turn are guided on a guide rail 8 extending parallel to the arm 5 and supported on uprights 8'. The wheels 7' may be driven by a drive motor, not shown, which is reversible so that the gripping and transfer device 4 may be moved to the right as shown by the arrow at the guide rail 8, or in the opposite direction. The horizontal distance between the grippers 6 and 6' is equal to the distance of the receiving station 10 from the center of the actual bending device 3.

It is to be understood that during transfer of a tube into the receiving station 10 the arm 5 and the grippers mounted thereon have to be moved to an upper position as will be explained later on in further detail.

It is therewith possible to grip by means of the gripper 6' a tube in the actual bending mechanism 3 and simultaneously to grip another tube 2 located at the receiving station 10 of the tube magazine 1. After lifting of the gripper 6, and 6' the whole gripping and transfer device may be moved along the guide rail 8 towards the right, as viewed in FIG. 2, so that a bent tube may for instance be deposited onto a depositing station 11 located at the right, as viewed in FIG. 2 of the actual tube bending mechanism 3, while at the same time a new tube 2 may be transferred from the receiving station 10 into the bending mechanism 3 as will be explained later on in further detail.

Figure 3:
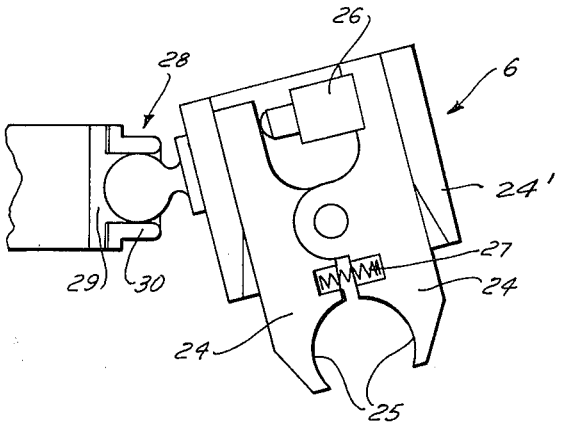
FIG. 3 is a schematic side view of one of the grippers and illustrating the elements for moving the gripper between an open and a closed position as well as elements for mounting the gripper adjustable in the universal direction.

Each of the grippers comprises, as shown for the gripper 6 in FIG. 3 a pair of jaws 24 mounted in a support member 24' intermediate the ends thereof for tilting movement about a tilting axis and each of the jaws is provided at the front end thereof with a cutout 25. A cylinder and piston unit 26 cooperates with the upper rear ends of the jaws for moving the jaws to a closed position, whereas a compression spring 27 arranged in cutouts in front portions of jaws 24 is adapted to move the jaws 24 to the open position when pressure fluid is discharged from the cylinder and piston unit 26. The jaw support 24' is mounted on the arm 5 by universally adjustable mounting means 28, including a ball 29 connected to the support 24' and engaged by clamp 30 which may be manually actuated between a clamping and a releasing position so that the support 24' of the jaws may be manually adjusted in a universal manner.

As shown in FIG. 1, the machine according to the present invention comprises a tube bending mechanism 3 of known construction and only schematically shown in FIG. 1. This tube bending mechanism 3 comprises, as known, a bending head 3' turnable about a vertical axis and carrying a pair of clamping jaws 17 and a clamping jaw operating cylinder 17*a* used to move the clamping jaws 17 between an open and a closed position. The bending head 3' is turned about its axis by drive means of known construction and not shown in the drawing. The bending mechanism 3 includes further a presser roller 17' actuated by a stationary cylinder-and-piston unit 17'*a* for movement between an active position as shown in FIG. 1 engaging a tube clamped between the clamping jaws 17 and a withdrawn inactive position. As further shown in FIG. 1 there is provided an inner mandrel 12 inserted in the tube 2 engaged in the tube bending mechanism 3. The mandrel 12 is movable out of the tube towards the rear of the latter as indicated by the arrow on the mandrel. For this purpose there is provided a hydraulically operated cylinder-and-piston unit 13 of a relatively short stroke which first loosens, when actuated, the mandrel 12 in the bent tube, whereafter the now loosened mandrel 12 is quickly pulled toward the right, as viewed in FIG. 1, by a tubular elongated cylinder-and-piston unit 14 having a long stroke. As shown in FIG. 1, the piston 13' of the cylinder and piston unit 13 is integrally formed with the cylinder of the cylinder-and-piston unit 14.

The tube 2 in the tube bending mechanism 3 is clamped in the region of its rear end thereof by a clamping collet 15 of known construction. This clamping collet 15 is actuated by a fluid-operated cylinder-and-piston unit 18 incorporated in an elongated tubular portion 16' mounted in a slide 16 immovably in axial direction, but turnable about its axis. In order to turn the tubular member 16' about its axis, a gear 21 is fixedly connected thereto for turning therewith and the gear 21 meshes with a pinion 20 on the output shaft of a stepping motor 19 carried by the slide 16. The slide 16 in turn is movable in longitudinal direction on guide rods 16*a* of a stationary frame and may be moved along the guide rods by drive means of known construction, not shown in the drawing, and preferably comprising fluid-operated cylinder-and-piston means.

The operating cycle of the tube bending machine may be broadly described as follows:

It is assumed that at the start a tube 2 is engaged with a portion thereof in the tube bending mechanism 3 and a mandrel 12 is inserted in the tube as shown in FIG. 1.

The tube engaged by the tube bending mechanism 3 is bent in a known manner. After the bending operation is finished, the gripping and transfer mechanism 4 is lowered by the cylinder 7 so that the tube in the bending mechanism 3 is gripped by the gripper 6' and the tube at the receiving station 10 of the tube magazine 1 is gripped by the gripper 6 of the gripper and transfer mechanism 4.

Subsequently thereto the mandrel 12 is retracted from the bent tube 2 by means of the cylinder-and-piston unit 13 and 14. Now, the gripper and transfer mechanism 4 is lifted by means of the cylinder and piston unit 7 and moved laterally toward the right, as viewed in FIG. 2 along the rail 8 so that the finished bent tube 2 is moved into the region of the depositing station 11 and a new tube to be bent is moved into the region of the tube bending mechanism 3.

By subsequently lowering the arm 5 with the two grippers 6 and 6' thereof by the cylinder-and-piston unit 7, the finished bent tube 2 can be placed onto the table at the depositing station 11, or at other apparatus for receiving the finished tube, for instance, engaging means for a following operating station, while a new tube to be bent is transferred from the receiving station 10 into the tube bending mechanism 3. The rear end of the tube 2 inserted in the tube bending mechanism 3 is then clamped by the collet 15 and the mandrel 12 is introduced over the rear end of the tube 2 into the latter. The gripping and transfer mechanism is then again moved upwardly in vertical direction and subsequently moved horizontally along the rail 8 to its starting position in the region of the left end of the rail, as shown in FIG. 2. The tube in the bending mechanism 3 is then bent and after the bending operation is finished, the above-described operating steps are repeated.

While all the above-described operating steps could be controlled by an operator, the operation of the tube bending machine according to the present invention may be carried out in an automatic manner in which successive steps are automatically controlled. Such an automatic operation will now be described on the basis of the step diagrams 4 and 5.

Figure 4:
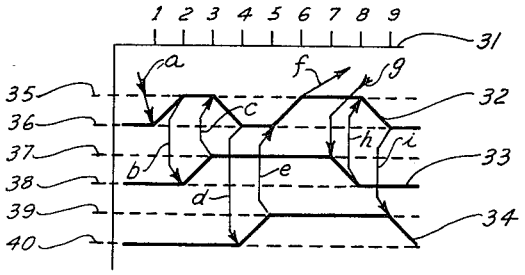
FIG. 4 is a diagram illustrating the movement of the grippers in successive steps.

Referring now first to FIG. 4 in which the successive steps of the gripper and transfer mechanism 4 are described, it is pointed out that line 31 of this diagram indicates the successive steps carried out by this mechanism, line 32 indicates the vertical movement of the arm 5, the full line 33 indicates the operation of the grippers 6 and 6' and the full line 34 the horizontal movement of the gripping and transfer device along the rail 8. The dotted line 35 indicates the lower and the dotted line 36 the upper position of the arm 5. The dotted line 37 indicates the closed position of the grippers 6 and 6' and the dotted line 38 the open position thereof. The dotted line 39 indicates the right hand end position of the gripping and transfer device as viewed in FIG. 2, and the dotted line 40 indicates the left end position thereof.

As can be seen from the step diagram of FIG. 4, at the start the arm 5 is in its upper position, the grippers 6 and 6' are open and the whole gripping and transfer mechanism is at its left end position. In step one an outside electrical signal, indicated by the arrow a and coming from the tube bending machine per se, as will be described later on in connection with the step diagram of FIG. 5, actuates a solemoid controlled valve, not shown in the drawing, and coordinated with the cylinder-and-piston unit 7 for feeding pressure fluid into the upper compartment of the cylinder, so that the arm 4 moves to the lower position as shown in FIG. 2. When the arm 4 reaches its lower position it initiates an electrical signal as indicated by the arrow b, which in turn controls an additional valve, not shown in the drawing, feeding pressure into the clamping cylinder 26 of each of the grippers 6 and 6' so that the grippers move from the open to the closed position, whereby the gripper 6 grips a tube at the receiving station 10 and the gripper 6' a finished bent tube in the tube bending mechanism 3. When the grippers close they initiate a further electrical signal as indicated by the arrow c, which controls the solenoid operated valve coordinated with the cylinder-and-piston unit 7 so that the latter is moved from its lower to its upper position. At the same time an outgoing signal indicated by the arrow a is produced which is transferred to the tube bending machine, as will be explained in connection with the diagram of FIG. 5. When the arm 5 reaches its upper position it produces a further electrical signal as indicated by the arrow d which in turn will start the drive motor for the wheels 7' of the gripping and transfer device 4 so that the latter moves from its left end position to its right end position as shown in the full line 34. When the gripping an transfer device 4 reaches its right hand end position, it initiates an other electrical signal, as indicated by the arrow e, which controls the solenoid valve coordinated with the cylinder-and-piston unit 7 causing thereby to move the arm 5 from its upper to its lower position as shown at line 32. When the arm 5 reaches the second time the lower position it initiates an outgoing signal as indicated by the arrow f. While the arm 5 is in its lower position an outside electrical signal, coming from the tube bending machine per se, as will be explained later on connection with FIG. 5, and indicated by the arrow g, controls the valve coordinated with the clamping cylinders 26 to discharge pressure fluid thereon so that the grippers 6 and 6' will open under the influence of the compression springs 27. When the grippers 6 and 6' are fully open, they produce an electrical signal as indicated by the arrow h, causing the solenoid operated valve coordinated with the cylinder-and-piston unit to raise the arm 4 from its lower again to its upper position as shown at line 32. When the arm 5 again reaches its upper position in initiates an electrical signal as indicated by the arrow i controlling the drive motor for the wheel 7' so that the gripping and transfer device is again moved back to its left hand end position as indicated by the line 34, whereafter all elements are again in the starting position and the above-described cycle of movements of the elements of the gripping and transfer device 4 may be repeated.

The various electrical impulses above mentioned may be produced by limit switches engaged by the respective elements upon reaching the above-described positions or by so-called electric eyes, well known in the art, in which a light ray is interrupted when the respective element reaches the above-described positions to thereby initiate an electrical impulse or signal. On the other hand the successive stops may be preprogramed on a tape, which produces, in the manner well known in the art, the sucessive signals in properly timed sequence.

Figure 5:
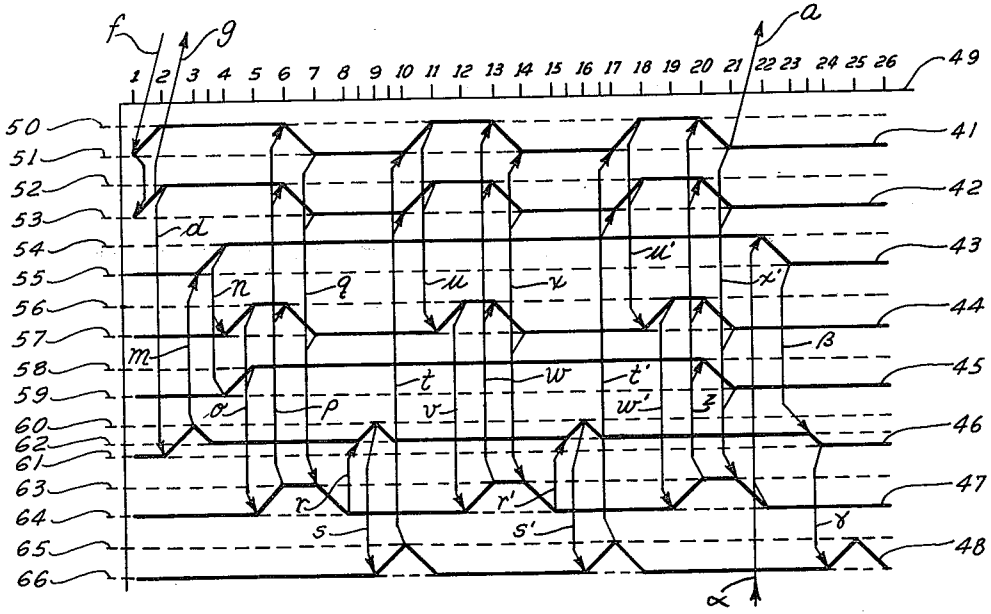
FIG. 5 is an additional diagram showing the movement of the various elements of the machine shown in FIG. 1 in successive steps.

Referring now to the step diagram of FIG. 5, in which the sequential stepwise movement of the various elements of the tube bending machine shown in FIG. 1 are illustrated, it is pointed out that the full line 41 illustrate the movement of the clamping jaws 17 of the tube bending mechanism 3, the full line 42 illustrates the movement of the pressure roller 17', the full line 43 illustrates the movement of the clamping collet 15, the full line 44 illustrates the movement of the piston 13', the full line 45 illustrates the movement of the piston 14', the full line 46 illustrates the movement of the slide 16, the full line 47 the angular movement of the bending head 3', and the full line 48 the movement of the step motor 19. Line 49 is the step scale in which a total of 26 steps are shown. The dotted line 50 indicates the closed position of the clamping jaws 17, the dotted line 51 the open position thereof, the dotted line 52 indicates the active position of the presser roller 17', and the dotted line 53 the inactive position thereof, the dotted line 54 indicates the closed position of the collet 15 and the dotted line 55 the open position thereof, the dotted line 56 indicates the forward or left position, as viewed in FIG. 1, of the piston 13 and the dotted line 57 the rear position thereof, the dotted line 58 indicates the forward or left position of the piston 14', and the dotted line 59 the rear or right position thereof, the dotted line 60 indicates the left or forward position of the slide 16 and the dotted line 61 the right end position thereof, whereas the dotted line 62 indicates a relieved condition of the fluid drive motor for the slide 16. Line 63 indicates the clockwise movement of the clamping head 3' and line 64 the counterclockwise movement thereof, the dotted line 65 indicates operation of the step motor 19 and the dotted line 66 indicates stop of the step motor.

As indicated in the step diagram of FIG. 5, at the start of the operation the clamping jaws 17 are open, the roller 17' is its inactive position, the collet 15 is open, the piston 13' is in its rear position and so is the piston 14', the slide 16 is in its rear hand end position, the bending head 3' is in its starting position as shown in FIG. 3, the drive motor 19 is stopped.

The outgoing signal, indicated by the arrow f at step 6 of the diagram shown in FIG. 4 actuates the solenoid operated valves, not shown in the drawing, respectively coordinated with the cylinder-and-piston unit 17*a* and 17'*a* causing thereby the clamping jaws 17 to engage the pipe 2 in the tube bending mechanism 3 and move the roller 17' to its active position as indicated in the full lines 41 and 42. When the aforementioned elements reach the mentioned positions thereof, one of these elements causes an electrical signal or impulse as indicated by the arrow 1 which actuates the solenoid valve, not shown in the drawing, coordinated with the fluid drive motor for the slide 16 to move the latter from its right hand to its left hand position as indicated in the full line 46. At the same time, an outgoing signal indicated by the upwardly directed arrow g is produced, which is the signal g shown in the step diagram of FIG. 4. As the slide 16 reaches its left end position it produces an electric impulse or signal indicated by the arrow m which is transferred to a solenoid operated valve, not shown in the drawing, coordinated with the cylinder and piston unit 18 which causes the collet 15 to move from its open to its closed position as indicated by the full line 43. After the collet 15 reaches its closed position, it initiates an electric signal indicated by the arrow n which is transferred to solenoid operated valves, not shown in the drawing, coordinated with the cylinder-and-piston unit 13 and 14 to move the pistons 13' and 14' to their left hand end position moving thereby the mandrel 12 into the tube 2. After the mandrel is inserted it produces an electric signal indicated by the arrow o which actuates the turning motor for the head 3' to turn the latter in clockwise direction bending thereby the tube. When the head 3' is fully turned in clockwise direction it produces an electric signal indicated by the arrow p which is transferred to the solenoid valve coordinated with the cylinder-and-piston unit 13 to move the piston 13' therein to its rear or right position, and this impulse p is also transferred to the solenoid operated valves coordinated with the cylinder-and-piston unit 17*a* and 17'*a* so that the presser roller 17 is moved to its inactive position while the jaws 17 open. This in turn will produce an electric impulse indicated by the arrow q which is transferred to the operating motor for the head 3' so that the latter moves in counterclockwise direction back to its starting position. When the head 3' reaches again its starting position, it initiates an electric signal as indicated by the arrow r which is transferred to the solenoid valve coordinated with the fluid operated drive for the slide 16 so that the latter moves again through a predetermined step towards the left, as viewed in FIG. 1, which moves the pipe through the same distance forwardly through the open clamping jaws 17 for a subsequent bending operation. When the slide 16 reaches its new position it initiates a signal indicated by the arrow s which starts the step motor 19 which in turn over the gear transmission 20 and 21 turns the tubular portion 16' of the slide through a predetermined angle. When the tubular portion 16' reaches its new turned position it initiates an electric signal indicated by the arrow t which is transferred to the solenoid operated valves coordinated with the cylinder-and-piston 17*a* and 17'*a* causing thereby the jaws 17 to move the closed position and the presser roller 17' to its active position. When these new positions are reached an electrical signal, as indicated by the arrow u, is produced which is transferred to the solenoid valve coordinated with the cylinder-and-piston unit 13 so that the piston therein moves to its forward position. When this forward position of the pistons 13' is reached it initiates an electric signal indicated by the arrow v, which is transferred to the drive motor for the head 3' turning the latter again in clockwise direction thus making an additional bend in the tube. When the head 3' reaches its turned end position, it initiates an electric signal, as indicated by the arrow w, which is transferred to the cylinder-and-piston unit 13 moving thereby the piston 13' from its forward to its rear position and at the same time the signal w is also transferred to the solenoid valves coordinated with the cylinder and piston units 17*a* and 17'*a* to cause the jaws 17 to move from the closed to the open position and the presser roller 17' from its active to its inactive position. When the aforementioned elements reach their new position, an electrical signal or impulse x is produced which is transferred to the drive motor for the head 3' so that the latter moves in counterclockwise direction back to its starting position. Upon reaching the starting position, an electrical signal r' is again produced which is transferred to the fluid drive of the slide 16 so that the latter moves again through a predetermined position towards the left. When the slide 16 reaches its new position it initiates again an electrical signal indicated by the arrow s' which starts the step motor 19 which turns the tubular portion 16' of the slide through a predetermined angle. When the tubular portion 16' reaches its new turned position, it initiates an electric signal indicated by the arrow t', which again is transferred to the cylinder and piston units 17*a* and 17'*a*, to thereby move the jaws 7 from the open to the closed position and the roller 17' from its inactive to the active position. This in turn produces an electric signal, indicated by the arrow u', which is transferred to the cylinder-and-piston unit 13 moving thereby the piston 13' from its rear to its forward position. This in turn produces an electric signal v' which is transferred to the drive motor for the head 3' to turn the latter again in clockwise direction thus producing a new bend in the tube. This in turn causes an electric signal, indicated by the arrow z, which is transferred to the solenoid valves coordinated with the cylinder-and-piston units 13 and 14 to cause the pistons 13' and 14' to move from their forward to their rear or right position causing thereby withdrawal of the mandrel 12 from the bent tube. The signal z is also transferred to the cylinder-and-piston unit 17*a*, and 17'*a* causing the jaws 17 to move to the open position and the roller 17' to its inactive position. When the aforementioned elements reach their new position, a signal x' is produced which is transferred to the drive motor for the head 3' so that the latter is turned in counterclockwise direction back to its starting position.

The signal x' produces also an outgoing signal indicated by the upwardly directed arrow a which is identical with the input signal shown in FIG. 4.

The outgoing signal indicated by the arrow $\alpha$ at stop 3 of the diagram of FIG. 4 is transferred to a valve coordinated with the cylinder-and-piston unit 18 causing the collet 15 to move from the closed to the open position and when the latter reaches its open position a signal is produced, as indicated by the arrow $\beta$ which is transferred to the valve coordinated with the fluid motor for the slide 16 which moves the latter to its right end position. When the slide 16 reaches its right end position it initiates a signal indicated by the arrow $\gamma$, which starts the step motor 19 so that the latter moves the tubular portion 16' of the slide back to its starting position. All elements of the bending machine are thus brought again to their starting position and the next cycle may begin.

It is again pointed out that the aforementioned signals or electrical impulses may be produced by limit switches or electrical eyes located in the path of the described elements, or as mentioned before, the successive steps may be preprogrammed on a tape, which produces, in the manner well known in the art, the succession signals in properly timed sequence.

It will be understood that each of the elements described above, or two or more together, may also find a useful application in other types of tube bending machines differing from the types described above.

While the invention has been illustrated and described as embodied in a tube bending machine in which an inner mandrel is inserted into and withdrawn from the tube to be bent through the rear end of the latter, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a tube bending machine with an inner mandrel, a combination comprising tube bending means; a tube magazine located at one side of said tube bending means for containing a plurality of parallel tubes to be bent; a depositing station located laterally of said tube bending means at the other side of the latter; gripping and transfer means for moving said tubes seriatim from said magazine to said tube bending means with a front portion of the respective tube located in said tube bending means and a rear portion thereof projecting rearwardly beyond said tube bending means, said gripping and transfer means being constructed for holding the respective tube parallel to the tubes in said magazine during the movement of the tubes from said magazine into said tube bending means; and means for moving said inner mandrel in axial direction through said portion into the tube after the front portion of the tube has been placed into said tube bending means and for moving said inner mandrel out of said rear portion of said tube after the front portion of the tube has been bent by said bending means, said gripping and transfer means serving also for transferring the bent tube into said depositing station after said mandrel has been withdrawn from the rear portion of the tube.

2. A combination as defined in claim 1, wherein said tube magazine includes a tube receiving station extending parallel to and laterally spaced at a given distance from the axis of said mandrel, and separator means for moving one tube after the other from the remainder of said magazine to said receiving station.

3. A combination as defined in claim 1, wherein said means for moving said inner mandrel in axial direction comprises a hydraulically operated mandrel loosening cylinder-and-piston unit with a short stroke and a pneumatically operated mandrel moving cylinder-and-piston unit with a long stroke.

4. A combination as defined in claim 3, wherein said tube bending means comprise a pair of jaws movable between an open and a closed position and including means cooperating with the jaws and said hydraulically operated mandrel loosening cylinder-and-piston unit for withdrawing the mandrel while said jaws move from said closed to said open position.

5. A combination as defined in claim 1, wherein said gripping and transfer means comprise an arm extending transverse to the axis of said mandrel, a pair of grippers on opposite ends of said arm, means connected at a fixed angle to said arm for lifting and lowering the same, and means for moving said lifting and lowering means together with said arm and said pair of grippers on the latter in a direction transverse to the axis of said mandrel, said last mentioned means comprising horizontally extending guide rails extending in said transverse direction and driven rollers connected to said lifting and lowering means for moving the latter along said guide rails.

6. A combination as defined in claim 5, wherein said means for lifting and lowering said arm comprise fluid operated cylinder and piston means for moving said arm in substantially vertical direction.

7. A combination as defined in claim 5, and including means mounting said grippers on said arm universally adjustable.

* * * * *